US009115614B2

(12) United States Patent
Hikita

(10) Patent No.: US 9,115,614 B2
(45) Date of Patent: Aug. 25, 2015

(54) LUBRICANT FEED MECHANISM FOR ENGINE

(71) Applicant: TAIHO KOGYO CO., LTD., Toyota-shi (JP)

(72) Inventor: Yasuhiro Hikita, Toyota (JP)

(73) Assignee: TAIHO KOGYO CO., LTD., Toyota-Shi, Aichi (JP)

( * ) Notice: Subject to any disclaimer, the term of this patent is extended or adjusted under 35 U.S.C. 154(b) by 0 days.

(21) Appl. No.: 14/401,339

(22) PCT Filed: May 30, 2013

(86) PCT No.: PCT/JP2013/065036

§ 371 (c)(1),
(2) Date: Nov. 14, 2014

(87) PCT Pub. No.: WO2013/183537

PCT Pub. Date: Dec. 12, 2013

(65) Prior Publication Data

US 2015/0136066 A1 May 21, 2015

(30) Foreign Application Priority Data

Jun. 6, 2012 (JP) ..... 2012-129276

(51) Int. Cl.
*F01M 1/02* (2006.01)
*F01M 9/10* (2006.01)
*F01M 1/08* (2006.01)

(52) U.S. Cl.
CPC ..... *F01M 9/101* (2013.01); *F01M 9/10* (2013.01); *F01M 1/08* (2013.01)

(58) Field of Classification Search
CPC ..... F01M 9/10; F01M 9/101; F01M 1/08
USPC ..... 123/90.33, 90.34, 196 R
See application file for complete search history.

(56) References Cited

U.S. PATENT DOCUMENTS 3,628,513 A * 12/1971 Grosseau ..... 123/90.34
5,492,086 A * 2/1996 Kuhns ..... 123/90.38

(Continued)

FOREIGN PATENT DOCUMENTS

JP 58-154806 U 10/1983
JP 62-116108 U 7/1987

(Continued)

OTHER PUBLICATIONS

International Search Report (PCT/ISA/210) mailed on Aug. 20, 2013, by the Japanese Patent Office as the International Searching Authority for International Application No. PCT/JP2013/065036.

(Continued)

*Primary Examiner* — Hung Q Nguyen
(74) *Attorney, Agent, or Firm* — Buchanan Ingersoll & Rooney PC

(57) ABSTRACT

Provided is a lubricant feed mechanism for an engine in which space above a cam cap is not used. A lubricant feed mechanism for an engine is configured to feed lubricant through a cylinder head, a camshaft, and a cam cap to a cam of a valve gear. The mechanism includes an oil feed member that is disposed in the cam cap such that an upper end thereof is set at a lower level than an upper end of the cam cap in a height-wise direction and has an oil passage configured to guide lubricant to be fed through the cam cap to the cam.

20 Claims, 14 Drawing Sheets

(56) References Cited

U.S. PATENT DOCUMENTS

| | | | | |
|---|---|---|---|---|
| 2003/0140886 | A1* | 7/2003 | Hada et al. | 123/195 A |
| 2007/0144471 | A1 | 6/2007 | Fujii et al. | |
| 2011/0083627 | A1 | 4/2011 | Hiramatsu et al. | |

FOREIGN PATENT DOCUMENTS

| | | | |
|---|---|---|---|
| JP | 63-112210 | U | 7/1988 |
| JP | 4-40106 | U | 4/1992 |
| JP | 7-63029 | A | 3/1995 |
| JP | 2005-194911 | A | 7/2005 |
| JP | 2007-032448 | A | 2/2007 |
| JP | 2009-121259 | A | 6/2009 |
| JP | 2010-164009 | A | 7/2010 |

OTHER PUBLICATIONS

International Preliminary Report on Patentability, completed Dec. 25, 2013, for PCT/JP2013/065036.

Office Action dated Nov. 24, 2014, issued by the Korean Patent Office in corresponding Korean Patent Application No. 10-2014-7028239. (4 pages).

Office Action issued on Feb. 26, 2015, by the Korean Intellectual Property Office in Korean Patent Application No. 10-2014-7028239. (4 pages).

Office Action issued on Apr. 20, 2015, by the Chinese Patent Office in corresponding Chinese Application No. 201380029564.1. (6 pages).

* cited by examiner

LUBRICANT FEED MECHANISM FOR ENGINE

TECHNICAL FIELD

The present invention relates to a technology of a lubricant feed mechanism for an engine for feeding lubricant to a cam of a valve gear through a cylinder head, a camshaft, and a cam cap.

BACKGROUND ART

A technology of a lubricant feed mechanism for an engine has been known by which lubricant is fed to a cam of a valve gear through a cylinder head, a camshaft, and a cam cap. Examples include JP-A-2010-164009.

A lubricant feed mechanism for an engine described in JP-A-2010-164009 includes a cylinder head having a bearing, a camshaft rotatably supported by the bearing, a cam cap fixedly attached to the cylinder head from the upper side to hold the camshaft therewith, and a cam shower pipe connected to an upper portion of the cam cap.

Further, the lubricant feed mechanism includes a communicating oil passage from an oil gallery of the cylinder head to the camshaft (bearing), an oil passage penetrating the camshaft (cam journal), and a communicating oil passage that is provided in the cam cap and connects the camshaft to the cam shower pipe.

In the lubricant feed mechanism thus configured, lubricant that circulates in the oil gallery can be fed to a plurality of cams of a valve gear through the cylinder head, the camshaft, the cam cap, and the cam shower pipe. Thus, lubricant of a substantially equal amount is fed to the plurality of cams by extracting lubricant from the oil gallery of a relatively large diameter, i.e., with a less pressure loss.

However, according to the technology described in JP-A-2010-164009, the cam shower pipe for feeding lubricant to the cams is positioned at an upper portion of the cam cap. Typically, the upper portion of a cam cap is covered with a cylinder head cover, and not much space is left above the cam cap. Hence, in actually applying the technology described in JP-A-2010-164009, the cam shower pipe may interfere with another member, such as a baffle plate positioned at the cylinder head cover side, which may involve additional design changes to avoid the interference.

DISCLOSURE OF THE INVENTION

Problems to be Solved by the Invention

The present invention was made in view of the foregoing circumstances, in order to provide a lubricant feed mechanism for an engine of which the use of the space above a cam cap is dispensed with.

Solutions to the Problems

A problem to be solved by the present invention is as described above, and techniques for solving the problem are described next.

More specifically, a lubricant feed mechanism for an engine according to the present invention is configured to feed lubricant to a cam of a valve gear through a cylinder head, a camshaft, and a cam cap. The mechanism includes an oil feed member disposed in the cam cap such that an upper end of the oil feed member is set at a lower level than an upper end of the cam cap in a height-wise direction, and the oil feed member has an oil passage configured to guide lubricant to be fed through the cam cap to the cam.

In the lubricant feed mechanism for an engine according to the present invention, the cam cap may have a recess provided around a bolt opening for fixedly attaching the cam cap to the cylinder head, and the oil feed member may have a portion contained within the recess and may be fixedly attached to the cylinder head together with the cam cap by a bolt.

In the lubricant feed mechanism for an engine according to the present invention, the oil feed member may include a plurality of panel members laid over each other, and the oil passage in the oil feed member may be entirely or partly a groove carved on at least one surface on which the panel members of the oil feed member abut each other.

In the lubricant feed mechanism for an engine according to the present invention, the oil passage in the oil feed member may have two branches from an upstream end portion or a middle portion of the oil passage in such a manner as to guide lubricant to two cams, and to feed an equal amount of lubricant to the two cams.

In the lubricant feed mechanism for an engine according to the present invention, the oil passage in the oil feed member may have two branches from an upstream end portion or a middle portion of the oil passage in such a manner as to guide lubricant to two cams, and to feed any different amounts of lubricant to the two cams.

In the lubricant feed mechanism for an engine according to the present invention, the panel member at the lowermost layer of the plurality of panel members configuring the oil feed member may be integrally provided with the cam cap having the oil feed member disposed thereon.

The lubricant feed mechanism for an engine according to the present invention may include a plurality of cam caps identical to the cam cap, the cam caps being integrally provided.

Effects of the Invention

The present invention provides effects as follows.

With the lubricant feed mechanism for an engine according to the present invention, lubricant is fed to a cam without using the space above the cam cap. With this configuration, interference between members is prevented, and design changes for avoiding the interference are obviated.

With the lubricant feed mechanism for an engine according to the present invention, the oil feed member is secured by using an existing bolt (a bolt for fixedly attaching the cam cap to the cylinder head). Thus, addition of a separate fastening member such as a bolt is dispensed with, and the number of components is reduced.

With the lubricant feed mechanism for an engine according to the present invention, formation of oil passages in the oil feed member is facilitated.

With the lubricant feed mechanism for an engine according to the present invention, two cams are lubricated equally.

With the lubricant feed mechanism for an engine according to the present invention, the amounts of lubricant to be fed, i.e., the oil feed amounts, to two cams may be deliberately made different. This allows for independent adjustment of the amount of lubricant to be fed to the two cams as desired.

With the lubricant feed mechanism for an engine according to the present invention, attachment of the oil feed member and the cam cap is facilitated with respect to the cylinder head.

With the lubricant feed mechanism for an engine according to the present invention, attachment of the cam cap is facilitated with respect to the cylinder head.

EMBODIMENTS OF THE INVENTION

Figure 1:
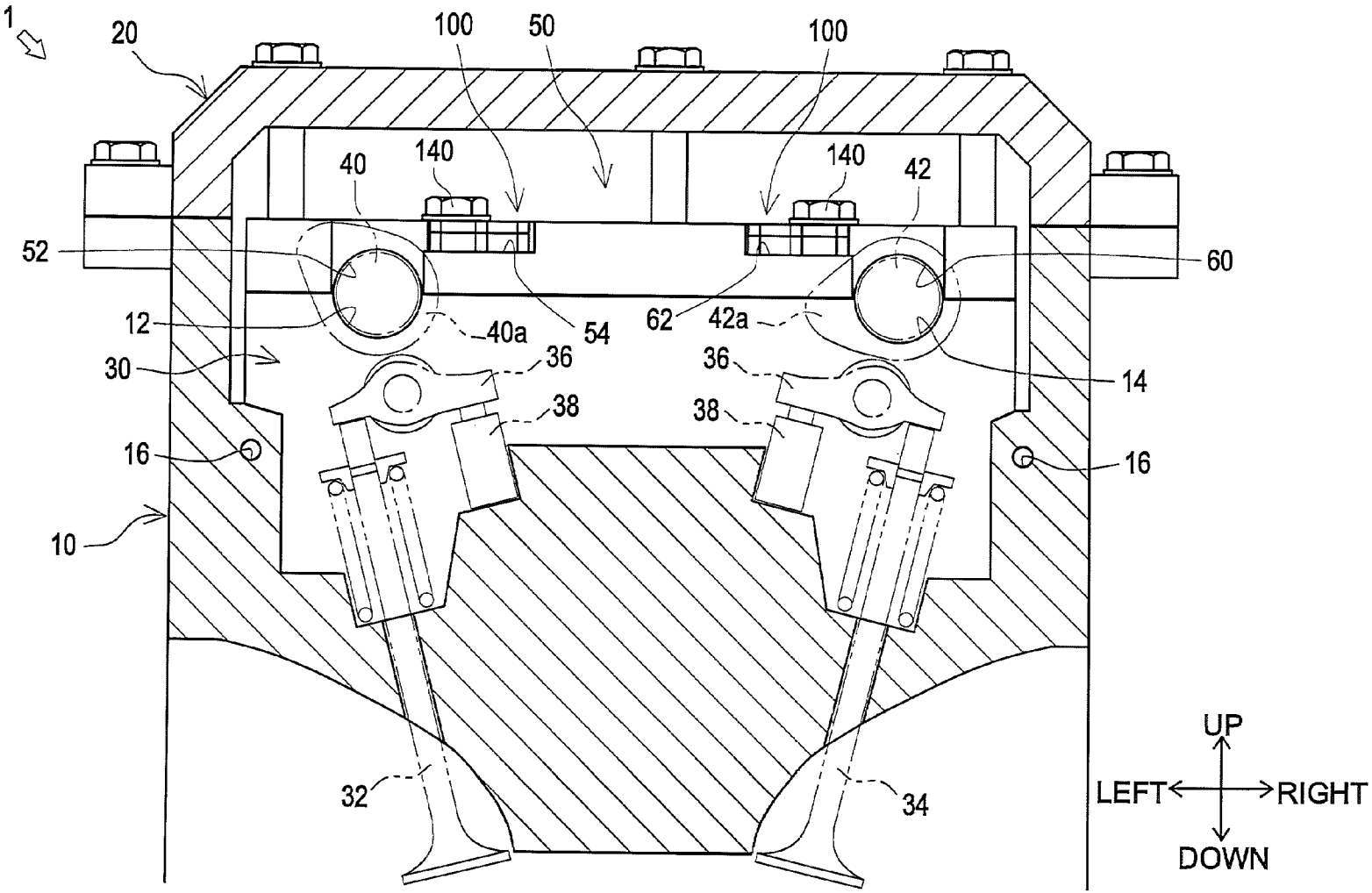
FIG. 1 is a cross-sectional view of the inside of a cylinder head cover of an engine according to a first embodiment of the present invention.

In the description below, the up-down direction, the right-left direction, and the front-back direction are defined by the arrows depicted in the figures.

First, description is given with reference to FIGS. 1 to 8D of a configuration of an engine 1 including a lubricant feed mechanism according to a first embodiment of the present invention.

The engine 1 according to the present embodiment is an inline 4-cylinder double overhead camshaft (DOHC) 16-valve gasoline engine. Description is given below mainly focusing on one cylinder of the four cylinders arranged in the front-back direction. The engine 1 mainly includes a cylinder head 10, a cylinder head cover 20, a valve gear 30, cam caps 50, and oil feed members 100.

Figure 3:
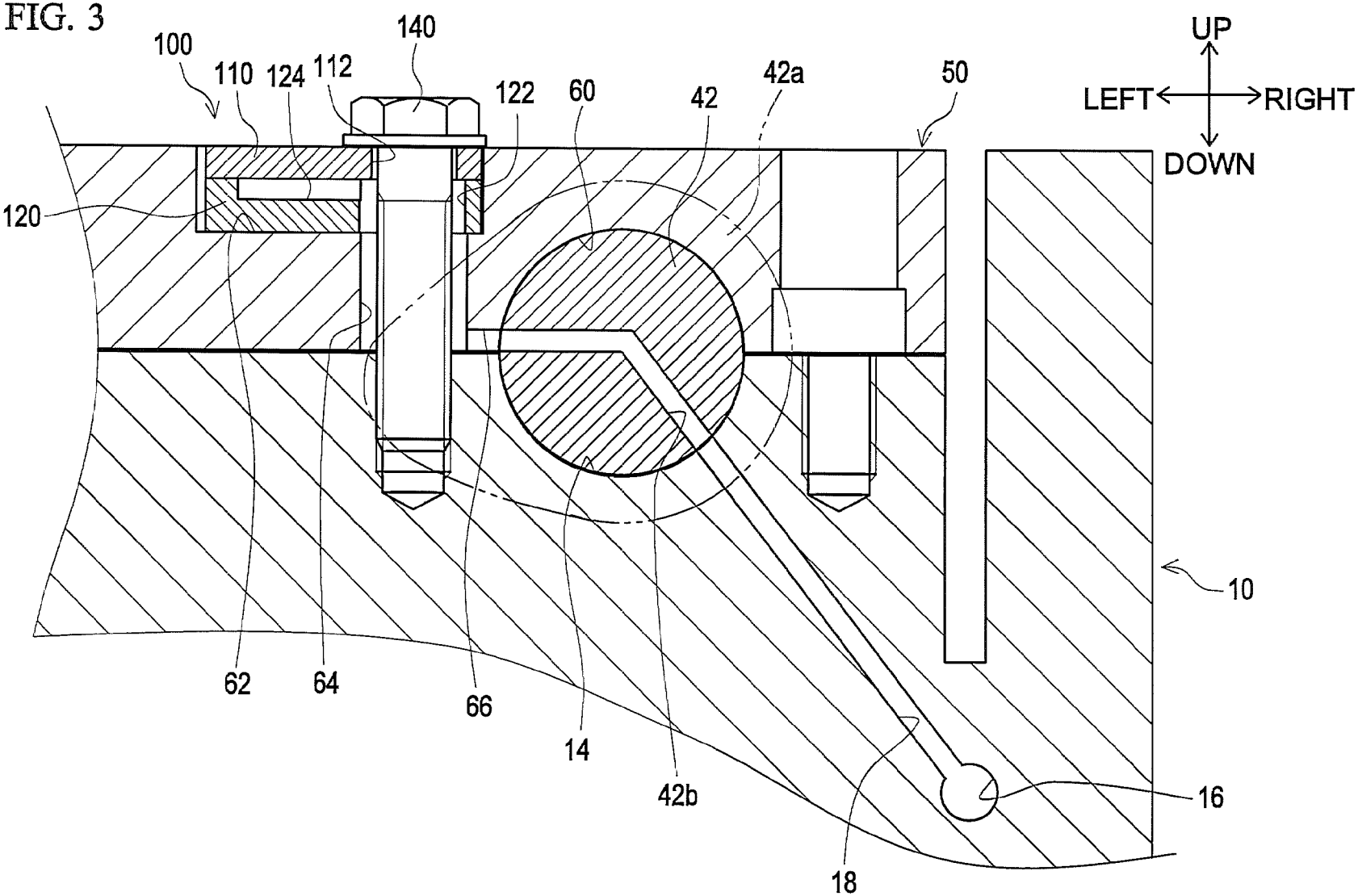
FIG. 3 is a cross-sectional view taken along line A-A in FIG. 2.
Figure 5:
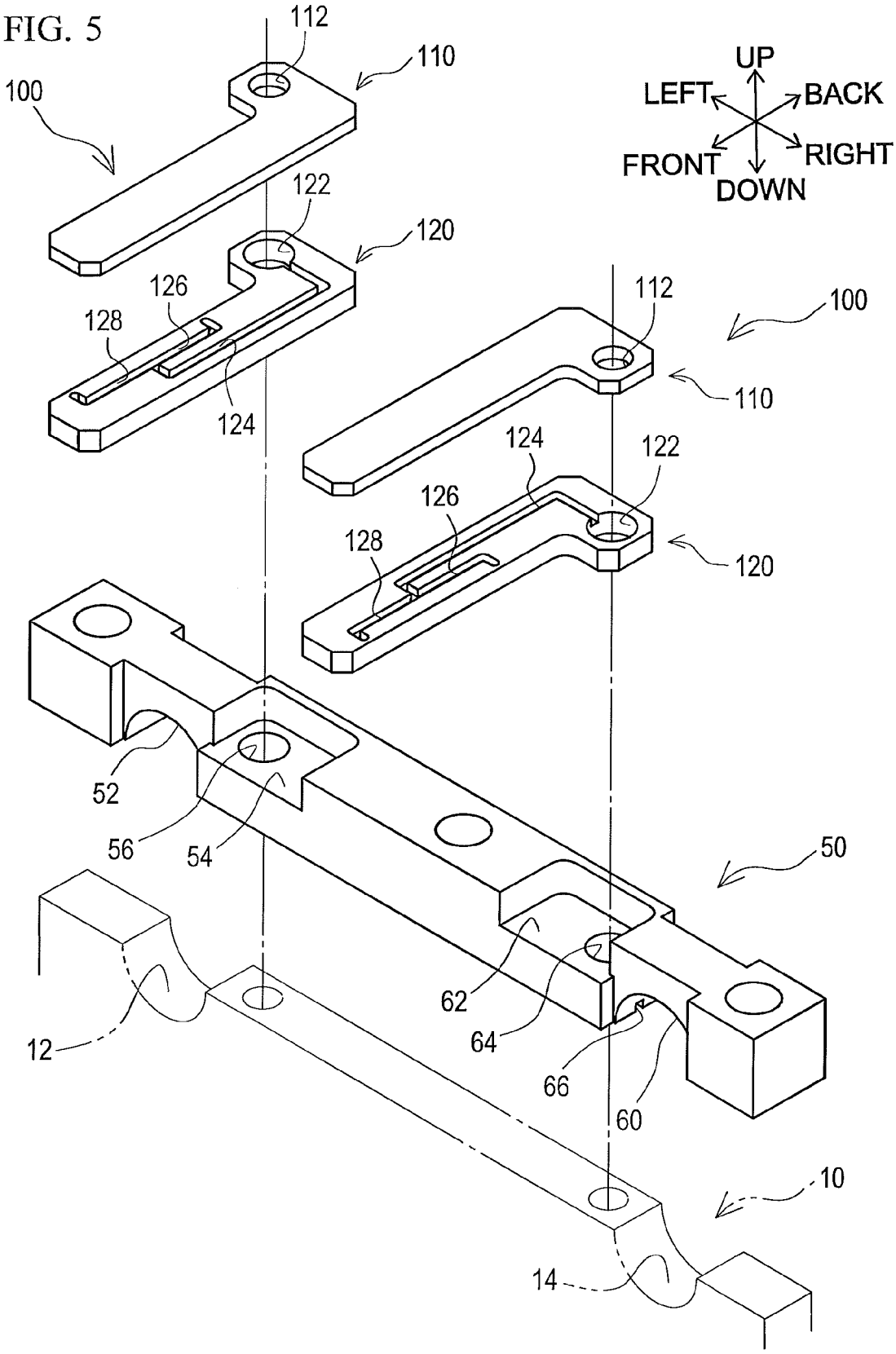
FIG. 5 is an exploded perspective view of the members depicted in FIG. 4.

The cylinder head 10 depicted in FIGS. 1, 3, and 5 makes a principal structural body of the engine 1 together with a cylinder block (not shown). The cylinder head 10 is fixedly attached to an upper portion of the cylinder block (not shown). The cylinder head 10 mainly includes a bearing 12 on the intake-side, a bearing 14 on the exhaust-side, an oil gallery 16, and a cam journal oil passage 18.

The intake-side bearing 12 depicted in FIGS. 1 and 5 rotatably supports from the lower side an intake-side camshaft 40 to be described later. The intake-side bearing 12 is provided at a left portion of the cylinder head 10 so as to be recessed in a semicircular shape with the upper side open in front view.

The exhaust-side bearing 14 depicted in FIGS. 1, 3, and 5 rotatably supports from the lower side an exhaust-side camshaft 42 to be described later. The exhaust-side bearing 14 is provided at a right portion of the cylinder head 10 so as to be recessed in a semicircular shape with the upper side open in front view.

The oil gallery 16 depicted in FIGS. 1 and 3 is an oil passage for guiding lubricant to various portions of the engine 1, such as a lash adjuster 38 to be described later. The oil gallery 16 is provided so as to pass the vicinity of a right and left sidewalls of the cylinder head 10 in the front-back direction.

The cam journal oil passage 18 depicted in FIG. 3 is provided at a right portion of the cylinder head 10 so as to guide lubricant to the exhaust-side bearing 14. The cam journal oil passage 18 has one end communicating with the oil gallery 16, whereas the cam journal oil passage 18 has the other end communicating with the exhaust-side bearing 14 of the cylinder head 10.

Although not illustrated in the present embodiment, the cam journal oil passage 18 is also provided at a left portion of the cylinder head 10 to communicate the oil gallery 16 on the left side with the intake-side bearing 12.

The cylinder head cover 20 depicted in FIG. 1 covers over the cylinder head 10. The cylinder head cover 20 is placed on an upper portion of the cylinder head 10 and is appropriately secured thereto by, for example, a bolt.

The valve gear 30 depicted in FIG. 1 is configured to open and close an intake port and an exhaust port (not shown) of the engine 1 at a predetermined timing. The valve gear 30 mainly includes an intake valve 32, an exhaust valve 34, rocker arms 36, lash adjusters 38, the intake-side camshaft 40, and the exhaust-side camshaft 42.

The intake valve 32 is configured to open and close the intake port (not shown) of the engine 1. The intake valve 32 is positioned with the longitudinal direction thereof directed substantially in the up-down direction. The intake valve 32 has a lower end extended to the intake port.

Although not illustrated in the present embodiment, two intake valves 32 are arranged in line in the front-back direction with respect to one cylinder.

The exhaust valve 34 is configured to open and close the exhaust port (not shown) of the engine 1. The exhaust valve 34 is positioned with the longitudinal direction thereof directed substantially in the up-down direction. The exhaust valve 34 has a lower end extended to the exhaust port.

Although not illustrated in the present embodiment, two exhaust valves 34 are arranged in line in the front-back direction with respect to one cylinder.

The rocker arms 36 are configured to openably/closably drive the intake valve 32 and the exhaust valve 34. The rocker arms 36 have one ends that abut the respective upper ends of the intake valve 32 and the exhaust valve 34 from the upper side.

The lash adjusters 38 are configured to adjust valve clearances. The lash adjusters 38 each abut the respective the other ends of the rocker arms 36 from the lower side.

Figure 2:
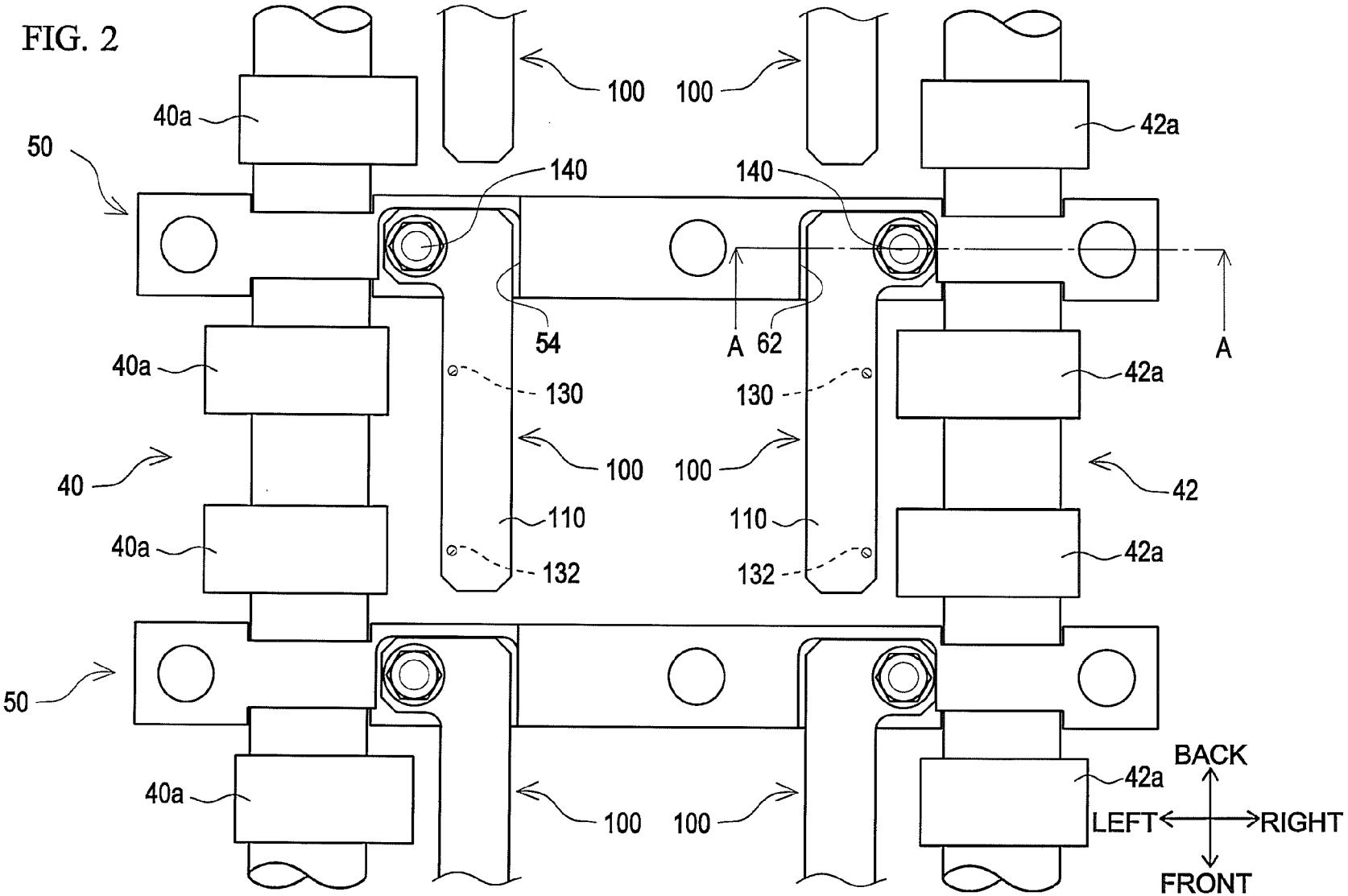
FIG. 2 is a plan view depicting cam caps and oil feed members.
Figure 4:
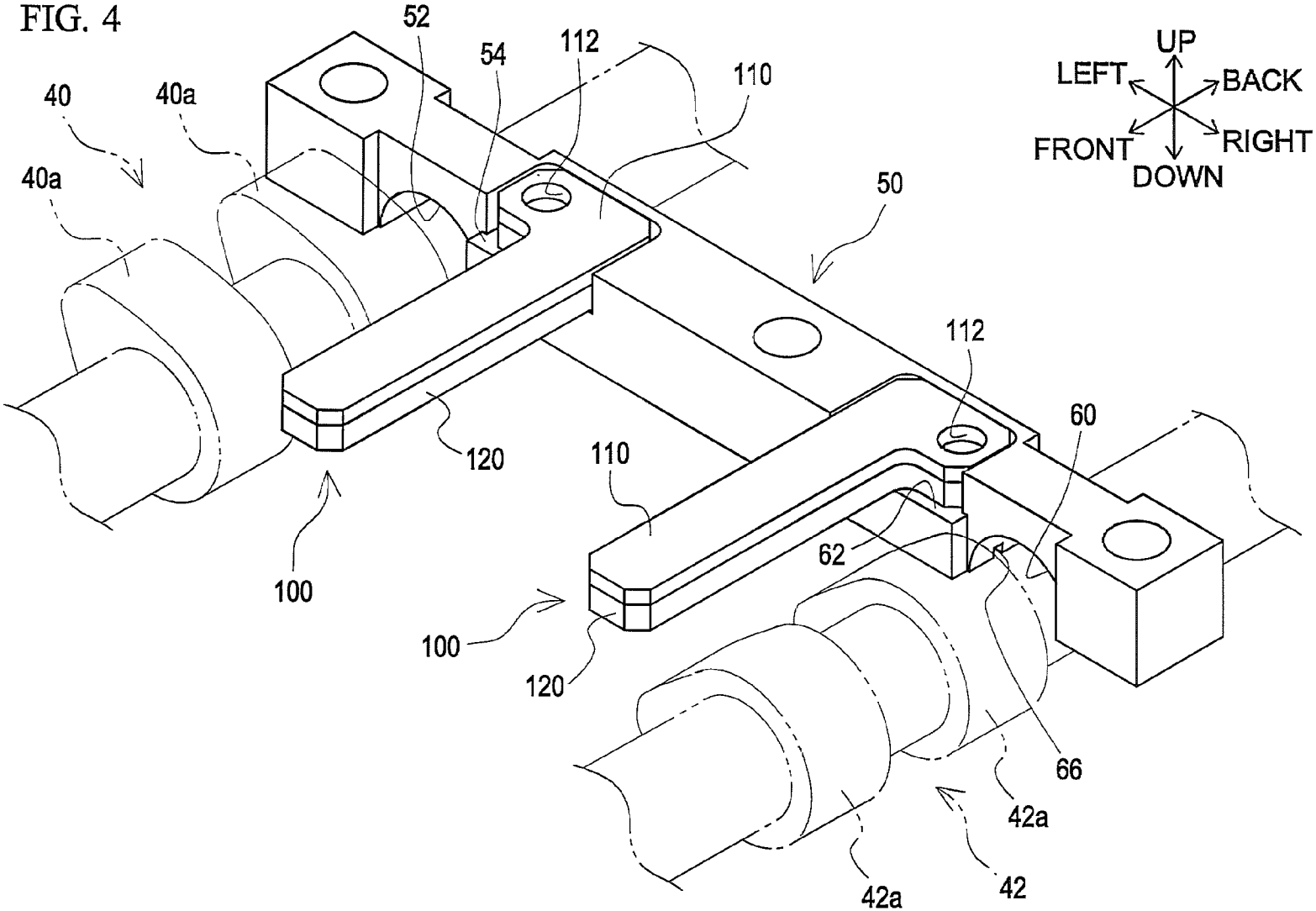
FIG. 4 is a perspective view depicting the cam cap and the oil feed members.

The intake-side camshaft 40 depicted in FIGS. 1, 2, and 4 is configured to rock a rocker arm 36 at a predetermined timing so as to openably/closably drive the intake valve 32. The intake-side camshaft 40 is placed on the intake-side bearing 12 of the cylinder head 10 with the longitudinal direction thereof directed in the front-back direction. The intake-side camshaft 40 mainly includes cams 40*a*.

The cams 40*a* are portions that have a planar shape with a non-uniform distance from the center of rotation, i.e., the center of the intake-side camshaft 40, to the outer periphery. Two cams 40*a* are arranged in line at a portion frontward of the portion (the cam journal) of the intake-side camshaft 40 placed on the intake-side bearing 12 of the cylinder head 10. The cams 40*a* abut the rocker arm 36 on the intake valve 32 side from the upper side.

The exhaust-side camshaft 42 depicted in FIGS. 1, 2, and 4 is configured to rock a rocker arm 36 at a predetermined timing so as to openably/closably drive the exhaust valve 34. The exhaust-side camshaft 42 is placed on the exhaust-side bearing 14 of the cylinder head 10 with the longitudinal direction thereof directed in the front-back direction. The exhaust-side camshaft 42 mainly includes cams 42*a* and an in-shaft oil passage 42*b*.

The cams 42*a* are portions that have a planar shape with a non-uniform distance from the center of rotation, i.e., the center of the exhaust-side camshaft 42, to the outer periphery. Two cams 42*a* are arranged in line at a portion frontward of the portion (the cam journal) of the exhaust-side camshaft 42 placed on the exhaust-side bearing 14 of the cylinder head 10. The cams 42*a* abut the rocker arm 36 on the exhaust valve 34 side from the upper side.

The in-shaft oil passage 42*b* depicted in FIG. 3 is provided in the portion (the cam journal) of the exhaust-side camshaft 42 placed on the exhaust-side bearing 14 of the cylinder head 10 and penetrates the exhaust-side camshaft 42. The in-shaft oil passage 42*b* is configured such that one end thereof, i.e., one of the openings thereof, opposes the cam journal oil passage 18 in the cylinder head 10 and the other end thereof, i.e., the other opening, faces leftward when the exhaust-side camshaft 42 rotates to a predetermined position.

Although not illustrated in the present embodiment, an oil passage similar to the in-shaft oil passage 42*b* in the exhaust-side camshaft 42 is provided in the intake-side camshaft 40.

The cam caps 50 depicted in FIGS. 1 to 6C are fixedly attached to the upper portion of the cylinder head 10 so as to hold the intake-side camshaft 40 and the exhaust-side camshaft 42 with the cylinder head 10. The cam caps 50 have a substantially rectangular parallelpiped shape with the longitudinal direction thereof directed in the right-left direction.

The cam caps 50 each mainly include a bearing 52 on the intake side, a recess 54 on the intake side, a throughhole 56 on the intake side, a communicating oil passage 58 on the intake side, a bearing 60 on the exhaust side, a recess 62 on the exhaust side, a throughhole 64 on the exhaust side, and a communicating oil passage 66 on the exhaust side.

The intake-side bearing 52 depicted in FIGS. 4 to 5 and 6B and 6C rotatably supports the intake-side camshaft 40 from the upper side. The intake-side bearing 52 is provided at a left portion of a cam cap 50 so as to be semicircularly recessed with the lower side open in front view. The intake-side bearing 52 of the cam cap 50 is provided at a position opposing the intake-side bearing 12 of the cylinder head 10, and the intake-side camshaft 40 is rotatably supported (held) between the intake-side bearing 52 and the intake-side bearing 12.

The intake-side recess 54 is provided at a left portion on the upper surface of the cam cap 50, i.e., immediately rightward of the intake-side bearing 52 in the right-left direction. The intake-side recess 54 is configured so as to be recessed downward to a certain depth from the periphery thereof and to be opened at the upper and front sides thereof.

Figure 6A:
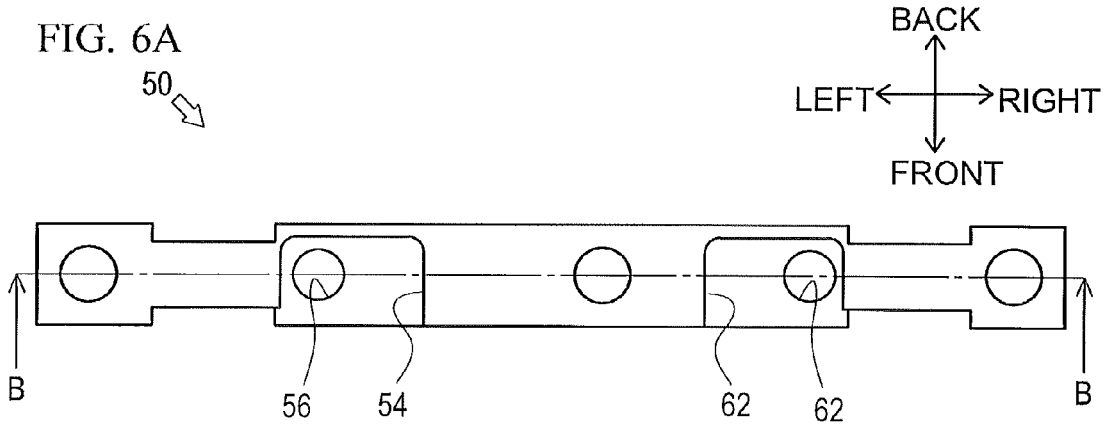
FIG. 6A is a plan view depicting the cam cap.
Figure 6B:
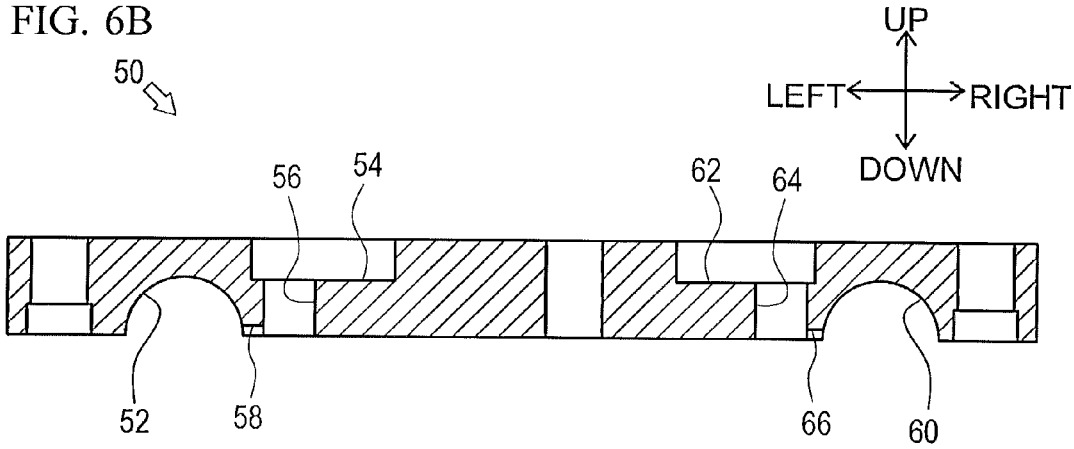
FIG. 6B is a front cross-sectional view depicting a cross section of the cam cap taken along line B-B.
Figure 6C:
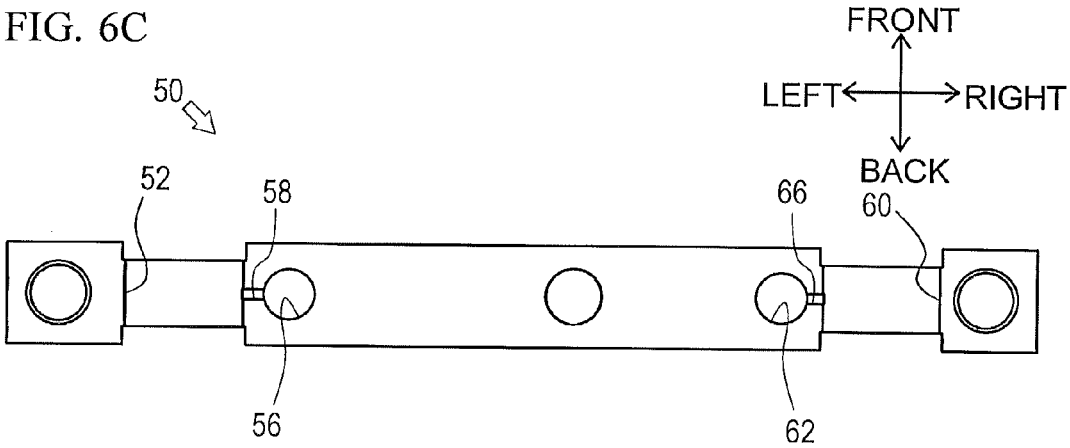
FIG. 6C is a bottom view depicting the cam cap.

The intake-side throughhole 56 depicted in FIGS. 5 to 6C is a bolt opening through which a bolt 140 to be described later is inserted to fixedly attach the cam cap 50 to the cylinder head 10. The intake-side throughhole 56 is provided so as to penetrate from a left portion on the bottom surface of the intake-side recess 54 to the lower surface of the cam cap 50. In other words, the intake-side recess 54 is provided around the upper end of the intake-side throughhole 56. The intake-side throughhole 56 has a diameter that is larger than the diameter of a shaft portion of the bolt 140 to be described later, namely, a diameter that will leave a gap between the intake-side throughhole 56 and the bolt 140 when the shaft portion of the bolt 140 is inserted through the intake-side throughhole 56.

The intake-side communicating oil passage 58 depicted in FIGS. 6B and 6C is configured to communicate the intake-side bearing 52 with the intake-side throughhole 56. The intake-side communicating oil passage 58 is provided at a substantially front-back-wise central portion on the lower surface of the cam cap 50. The intake-side communicating oil passage 58 has one end communicating with the intake-side bearing 52, and the intake-side communicating oil passage 58 has the other end communicating with the intake-side throughhole 56.

The exhaust-side bearing 60 depicted in FIGS. 3 to 5 and 6B and 6C rotatably supports the exhaust-side camshaft 42 from the upper side. The exhaust-side hearing 60 is provided at a right portion of the cam cap 50 so as to be semicircularly recessed with the lower side open in front view. The exhaust-side bearing 60 of the cam cap 50 is provided at a position opposing the exhaust-side bearing 14 of the cylinder head 10, and the exhaust-side camshaft 42 is rotatably supported (held) between the exhaust-side bearing 60 and the exhaust-side bearing 14.

The exhaust-side recess 62 is provided at a right portion on the upper surface of the cam cap 50, i.e., immediately leftward of the exhaust-side bearing 60 in the right-left direction. The exhaust-side recess 62 is configured so as to be recessed downward to a certain depth from the periphery thereof and to be opened at the front and upper sides thereof.

The exhaust-side throughhole 64 depicted in FIGS. 3 and 5 and 6B is a bolt opening through which a bolt 140 to be described later is inserted to fixedly attach the cam cap 50 to the cylinder head 10. The exhaust-side throughhole 64 is provided so as to penetrate from a right portion on the bottom surface of the exhaust-side recess 62 to the lower surface of the cam cap 50. In other words, the exhaust-side recess 62 is provided around the upper end of the exhaust-side throughhole 64. The exhaust-side throughhole 64 has a diameter that is larger than the diameter of the shaft portion of the bolt 140 to be described later, namely, a diameter that will leave a gap between the exhaust-side throughhole 64 and the bolt 140 when the shaft portion of the bolt 140 is inserted through the exhaust-side throughhole 64.

The exhaust-side communicating oil passage 66 depicted in FIGS. 3 to 5 and 6B and 6C is configured to communicate the exhaust-side bearing 60 with the exhaust-side throughhole 64. The exhaust-side communicating oil passage 66 is provided at a substantially front-back-wise central portion on the lower surface of the can cap 50. The exhaust-side communicating oil passage 66 has one end communicating with the exhaust-side bearing 60, and the exhaust-side communicating oil passage 66 has the other end communicating with the exhaust-side throughhole 64.

The oil feed members 100 depicted in FIGS. 1 to 5 are configured to guide lubricant to a cam 40*a* of the intake-side camshaft 40 and a cam 42*a* of the exhaust-side camshaft 42.

Since the configuration of the oil feed member 100 for guiding lubricant to a cam 40*a* of the intake-side camshaft 40, i.e., the oil feed member 100 positioned on the left side, is right-left symmetrical with respect to the configuration of the oil feed member 100 for guiding lubricant to a cam 42*a* of the exhaust-side camshaft 42, i.e., the oil feed member 100 positioned on the right side, detailed description is specifically given of the oil feed member 100 positioned on the right side, and description is not given of the oil feed member 100 positioned on the left side.

The oil feed member 100 is formed by laying a plurality of (two in the present embodiment) panel members over one another. The oil feed member 100 mainly includes a first panel member 110 and a second panel member 120.

Figure 7A:
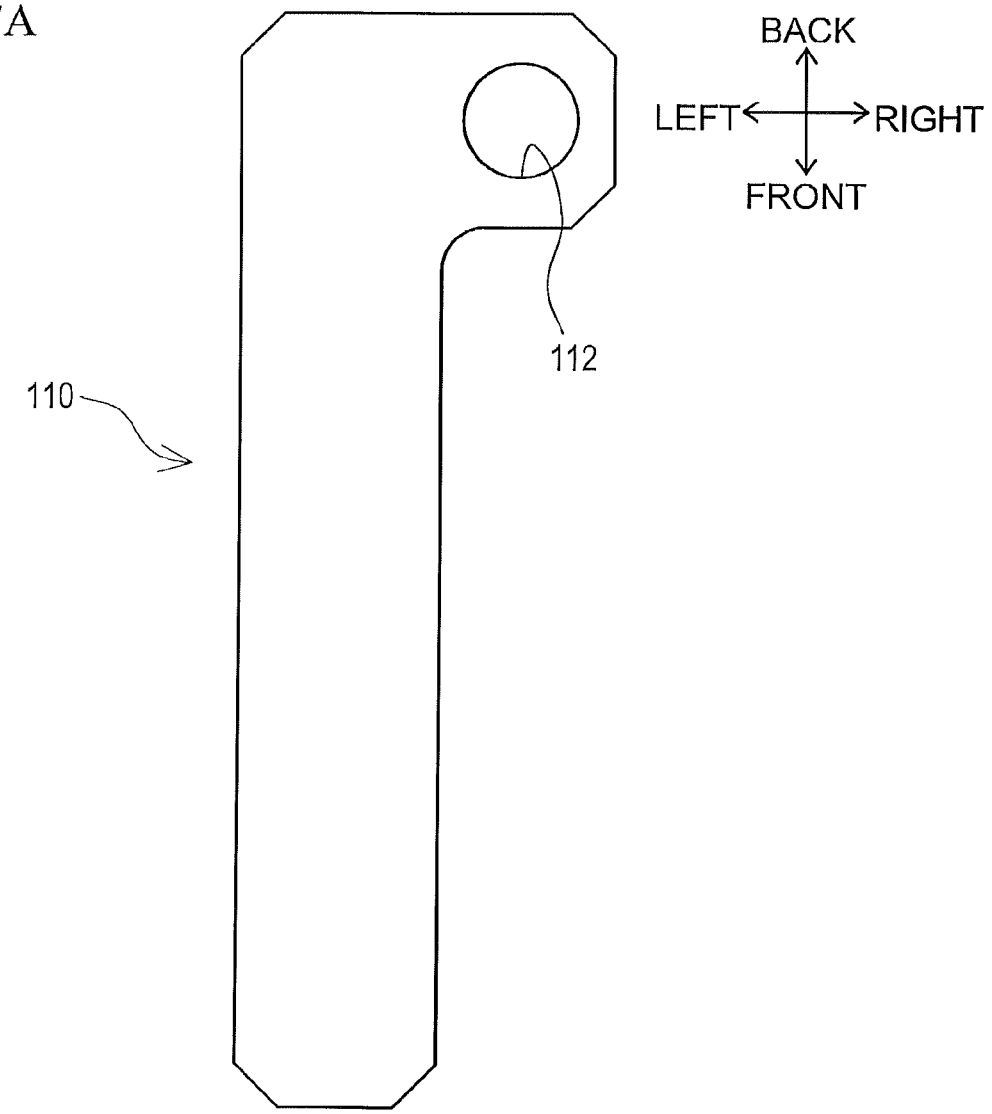
FIG. 7A is a plan view of a first panel member.
Figure 7B:
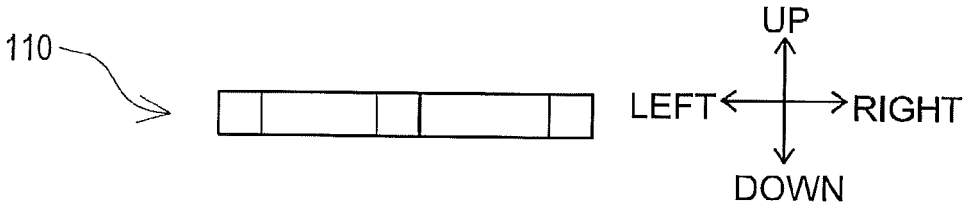
FIG. 7B is a front view of the first panel member.
Figure 8A:
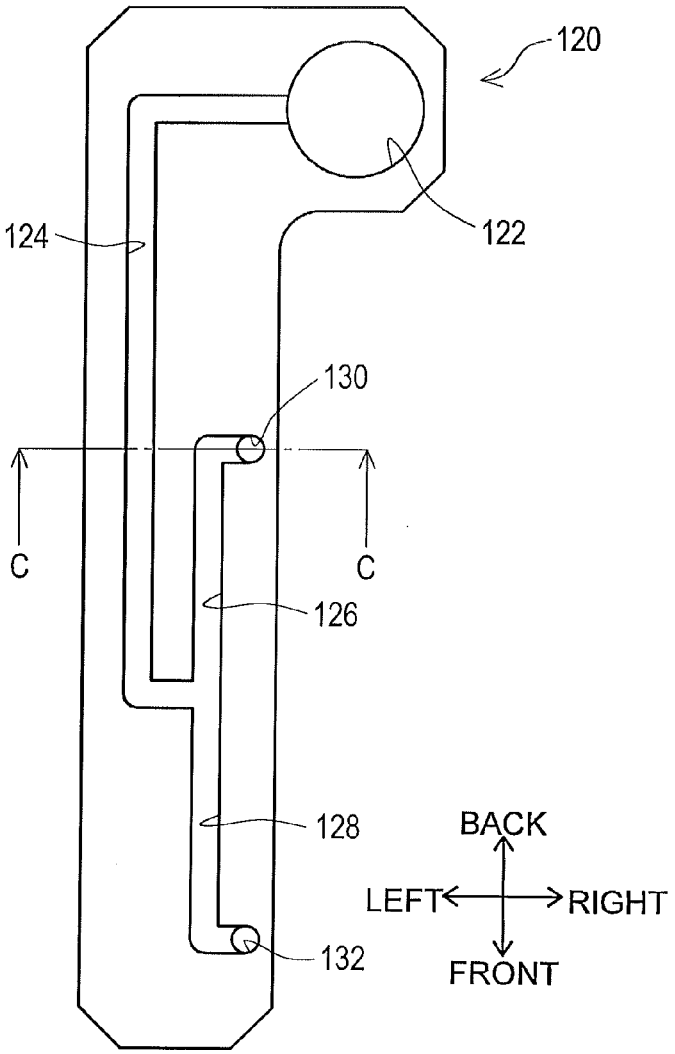
FIG. 8A is a plan view depicting a second panel member.
Figure 8B:
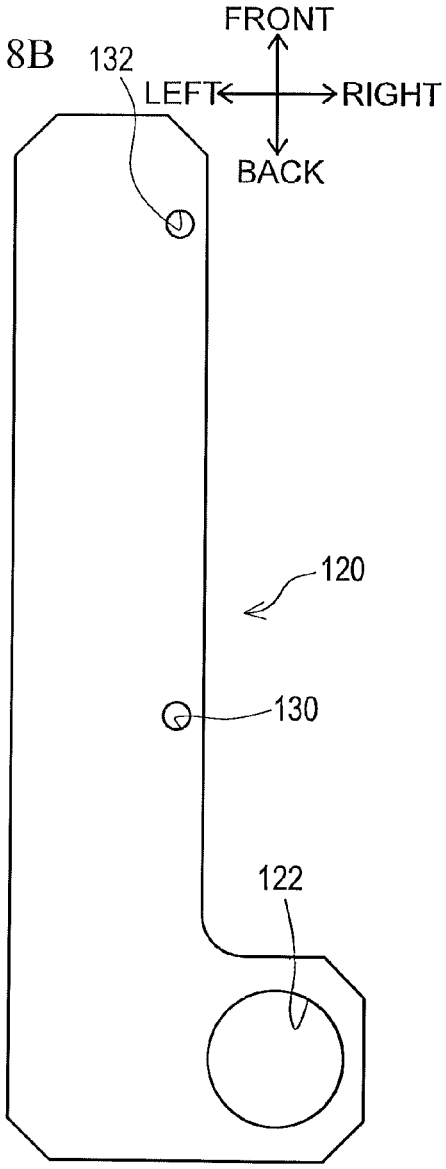
FIG. 8B is a bottom view of the second panel member.
Figure 8C:
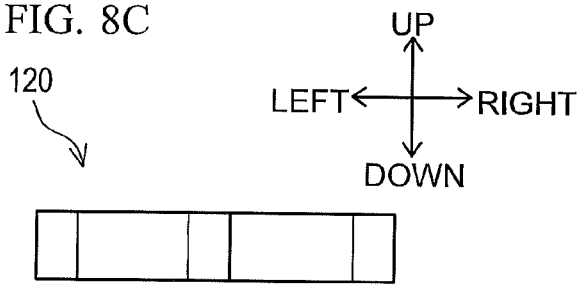
FIG. 8C is a front view of the second panel member.
Figure 8D:
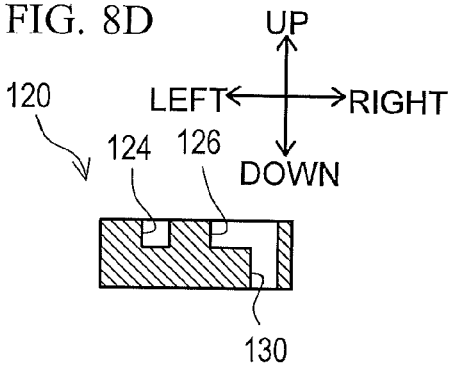
FIG. 8D is a front cross-sectional view depicting a cross section of the second panel member taken along line C-C.

The first panel member 110 depicted in FIGS. 5 and 7A and 7B is a planer member configuring an upper portion of the oil feed member 100. The first panel member 110 is positioned with the planer surface thereof directed in the up-down direction. The first panel member 110 has a substantially L-shape in plan view. More specifically, the first panel member 110 is shaped so as to have a shorter side directed in the right-left direction and a longer side extended from a left end portion of the shorter side toward the front. A throughhole 112 is provided in the vicinity of the right end portion of the shorter side of the first panel member 110 so as to penetrate the first panel member 110 in the up-down direction.

The second panel member 120 depicted in FIGS. 5 and 8A to 8D is a planar member configuring a lower portion of the oil feed member 100. The second panel member 120 is positioned with the planar surface thereof directed in the up-down direction. The second panel member 120 has a substantially L-shape in plan view like the first panel member 110.

The second panel member 120 mainly includes a throughhole 122, a first oil passage 124, a second oil passage 126, a third oil passage 128, a first discharge port 130, and a second discharge port 132.

The throughhole 122 penetrates the second panel member 120 in the up-down direction. The throughhole 122 is provided at a position that is in the vicinity of the right end portion of the shorter side of the second panel member 120 and overlaps the throughhole 112 in the first panel member 110 in plan view. The throughhole 122 has a diameter that is larger than the diameter of the shaft portion of the bolt 140 to be described later, namely, a diameter that will leave a gap between the throughhole 122 and the bolt 140 when the shaft portion of the bolt 140 is inserted through the throughhole 122.

The first oil passage 124 is a groove that is provided on the upper surface of the second panel member 120 and is carved for guiding lubricant. The first oil passage 124 has one end communicating with the throughhole 122. The first oil passage 124 is extended leftward from the throughhole 122, is extended frontward from a left end portion to which the passage is extended leftward, and is extended rightward from a front end portion to which the passage is extended frontward.

The second oil passage 126 is a groove that is provided on the upper surface of the second panel member 120 and is carved for guiding lubricant. The second oil passage 126 has one end communicating with the other end, i.e., the right front end, of the first oil passage. The second oil passage 126 is extended backward from the other end, i.e., the right front end, of the first oil passage 124 and is extended rightward from a back end portion to which the passage is extended backward.

The third oil passage 128 is a groove that is provided on the upper surface of the second panel member 120 and is carved for guiding lubricant. The third oil passage 128 has one end communicating with the other end, i.e., the right front end, of the first oil passage. The third oil passage 128 is extended frontward from the other end, i.e., the right front end, of the first oil passage 124 and is extended rightward from a front end portion to which the passage is extended frontward.

As described above, the second oil passage 126 and the third oil passage 128 are provided so as to branch off from the other end, i.e., the right front end, of the first oil passage 124. Further, the second oil passage 126 and the third oil passage 128 are provided symmetrically in the front-back direction with respect to the axis in the right-left direction that passes the branch point in the first oil passage 124, i.e., the other end of the first oil passage 124. Further, the second oil passage 126 and the third oil passage 128 are configured so as to have an identical cross-sectional shape.

The first discharge port 130 is an aperture that penetrates the second panel member 120 in the up-down direction for discharging lubricant downward of the second panel member 120. The first discharge port 130 is provided so as to communicate the other end, i.e., the right back end, of the second oil passage 126 with the lower surface of the second panel member 120.

The second discharge port 132 is an aperture that penetrates the second panel member 120 in the up-down direction for discharging lubricant downward of the second panel member 120. The second discharge port 132 is provided so as to communicate the other end, i.e., the right front end, of the third oil passage 128 with the lower surface of the second panel member 120.

The second discharge port 132 has an identical shape (cross-sectional shape) with that of the first discharge port 130.

As depicted in FIGS. 4 and 5, the first panel member 110 configured as above is laid over the second panel member 120, namely, the lower surface of the first panel member 110 and the upper surface of the second panel member 120 are brought into abutment with each other, and are secured by using, for example, a bolt (not shown), so as to configure the oil feed member 100. In so doing, the first oil passage 124, the second oil passage 126, and the third oil passage 128 that are provided on the second panel member 120 are closed with the first panel member 110 from the upper side, thus allowing lubricant to be guided from the throughhole 122 to the first discharge port 130 and to the second discharge port 132. In other words, the throughhole 122, the first oil passage 124, the second oil passage 126, the third oil passage 128, the first discharge port 130, and the second discharge port 132 configure an oil passage through which lubricant circulates.

Also as depicted in FIGS. 3 to 5, the back end portion of the oil feed member 100, i.e., the shorter side portions of the first panel member 110 and the second panel member 120, is contained within the exhaust-side recess 62 in the cam cap 50. The throughholes in the oil feed member 100, i.e., the throughhole 112 in the first panel member 110 and the throughhole 122 in the second panel member 120, are arranged so as to overlap the exhaust-side throughhole 64 in the cam cap 50 in plan view. The bolt 140 is inserted through the throughholes from the upper side, such that the bolt 140 is fastened to the cylinder head 10. In this manner, the oil feed member 100 is fixedly attached to the cam cap 50 by the bolt 140, and the cam cap 50 is fixedly attached to the cylinder head 10.

In so doing, the thickness of the oil feed member 100, i.e., a total of the thicknesses in the up-down direction of the first panel member 110 and the second panel member 120, is set so as to be the same or smaller than the depth of the exhaust-side recess 62 in the cam cap 50. Thus, the upper end of the oil feed member 100 comes at a lower level than the upper end of the cam cap 50 in a height-wise direction (in the up-down direction) even after the oil feed member 100 is secured to the cam cap 50, and the oil feed member 100 does not project upward from the cam cap 50.

Further, when the oil feed member 100 is secured to the cam cap 50, as depicted in FIG. 2, the first discharge port 130 and the second discharge port 132 are each disposed so as to hold the same positions as the cams 42*a* on the exhaust-side camshaft 42 in the front-back direction. Hence, the first discharge port 130 and the second discharge port 132 are each located approximately above the cams 42*a* on the exhaust-side camshaft 42.

Description is given below with reference to FIGS. 8A to 10 of modes of feeding lubricant to the cams 42*a* on the exhaust-side camshaft 42 by using the lubricant feed mechanism for the engine 1 configured as above.

It is to be noted that, since the mode of feeding lubricant to the cams 40*a* on the intake-side camshaft 40 by using the lubricant feed mechanism for the engine 1 is substantially the same, description thereof is not given below.

Figure 9A:
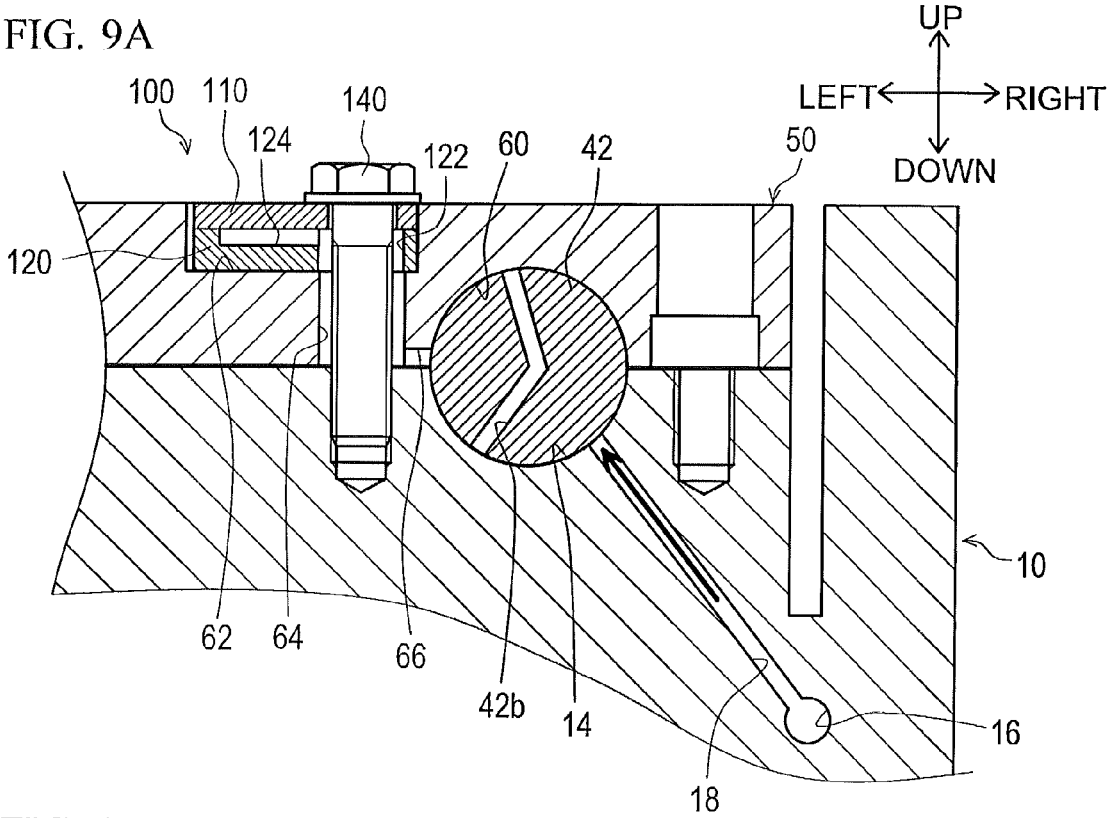
FIG. 9A is a cross-sectional view taken along line A-A in FIG. 2 where lubricant is not fed to an in-shaft oil passage.

As depicted in FIG. 9A, the engine 1 is driven to cause the exhaust-side camshaft 42 to rotate, and the lubricant circulating through the oil gallery 16 is fed through the cam journal oil passage 18 to the exhaust-side bearing 14 when the one end of the in-shaft oil passage 42*b* does not oppose the cam journal oil passage 18 in the cylinder head 10. The lubricant is not fed into the in-shaft oil passage 42*b* but lubricates the sliding surface between the exhaust-side camshaft 42 and the exhaust-side bearing 14 (and the exhaust-side bearing 60).

Figure 9B:
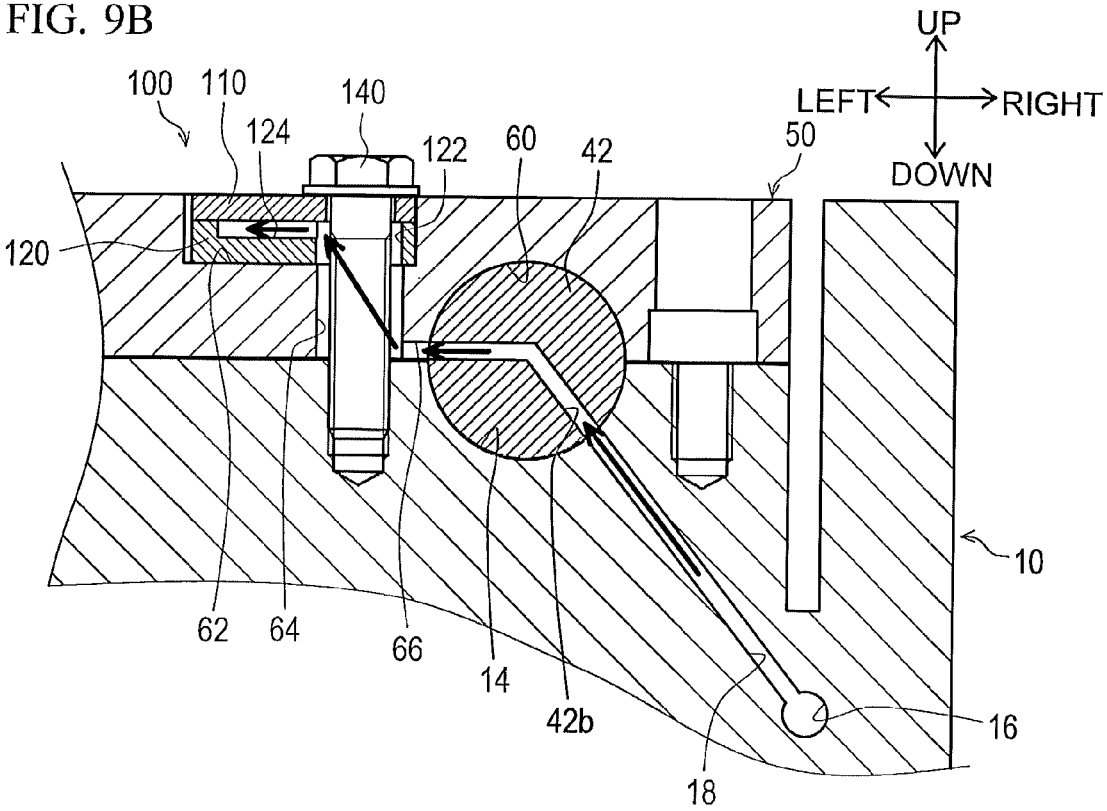
FIG. 9B is a cross-sectional view taken along line A-A in FIG. 2 where lubricant is fed to the in-shaft oil passage.
Figure 10:
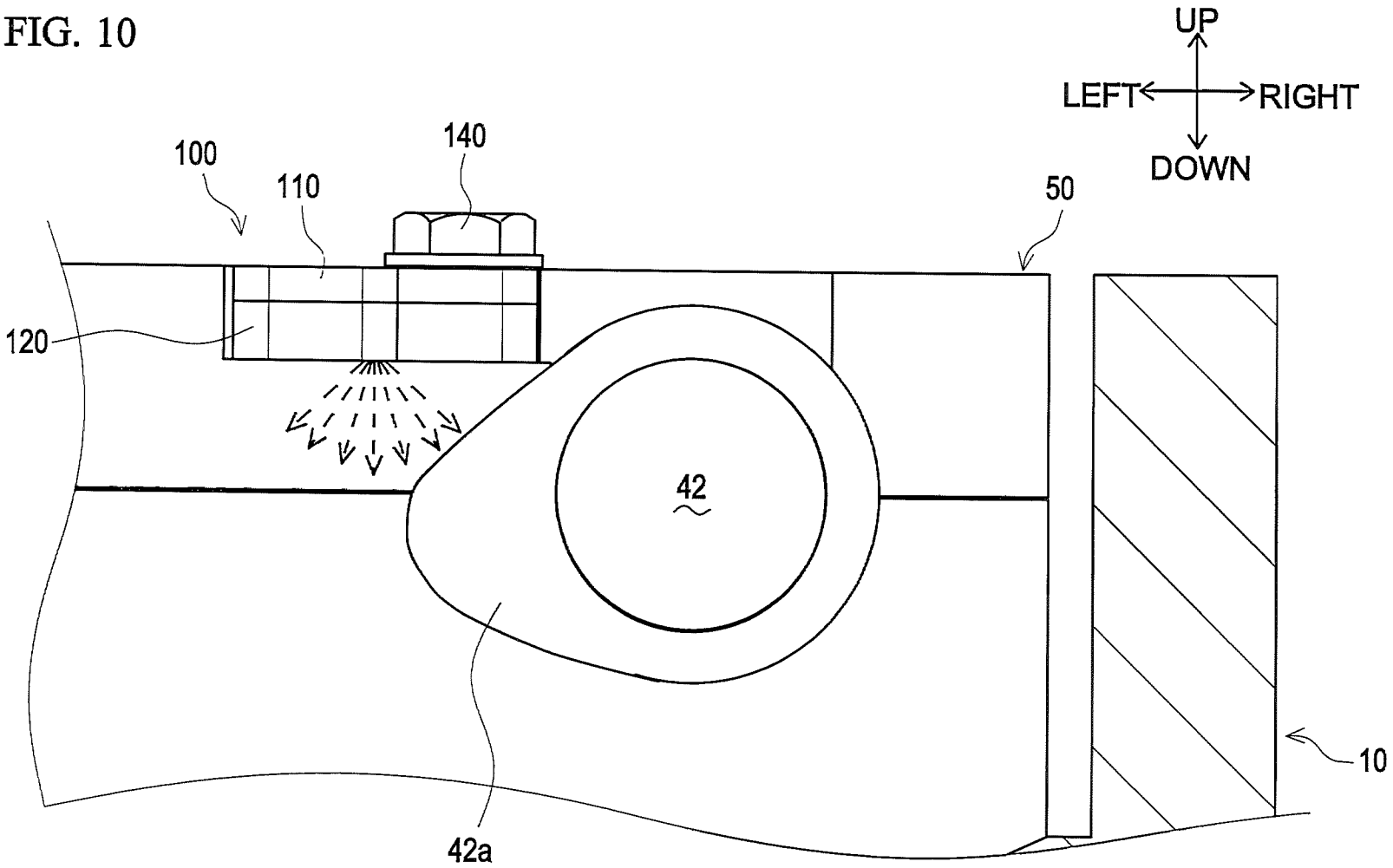
FIG. 10 is a front view depicting a state in which lubricant is discharged from the oil feed member to a cam.

As depicted in FIG. 9B, per 360-degree rotation of the exhaust-side camshaft 42, the one end of the in-shaft oil passage 42*b* opposes the cam journal oil passage 18 in the cylinder head 10 once, and the other end of the in-shaft oil passage 42*b* also opposes the exhaust-side communicating oil passage 66. In this case, lubricant flowing in the oil gallery 16 is fed through the cam journal oil passage 18 into the in-shaft oil passage 42*b*. Further, the lubricant is fed through the in-shaft oil passage 42*b* and the exhaust-side communicating oil passage 66 into the exhaust-side throughhole 64. The bolt 140 is inserted through the exhaust-side throughhole 64, while a gap is provided between the exhaust-side throughhole 64 and the bolt 140, thus allowing the lubricant to circulate inside the exhaust-side throughhole 64. The lubricant flows upward in the exhaust-side throughhole 64 and is fed to the oil feed member 100, more specifically, into the throughhole 122 in the second panel member 120.

The lubricant fed to the throughhole 122 in the second panel member 120 flows in the first oil passage 124 and is fed being branched from the other end, i.e., the right front end, of the first oil passage 124 to the second oil passage 126 and to the third oil passage 128 (see, for example, FIG. 8A to 8D). The lubricant fed to the second oil passage 126 is discharged downward through the first discharge port 130. The lubricant fed to the third oil passage 128 is discharged downward through the second discharge port 132. As indicated by the broken line in FIG. 10, the lubricant discharged from the first discharge port 130 and the second discharge port 132 in the oil feed member 100 is fed to the cams 42*a* that are arranged at the lower side of the first discharge port 130 and the second discharge port 132, thus lubricating the cams 42*a*.

In this manner, lubricant is fed to the cams 42*a* when the exhaust-side camshaft 42 rotates by a predetermined angle. More specifically, lubricant is intermittently, i.e., once during one rotation of the exhaust-side camshaft 42, to the cams 42*a*. Thus, lubricant is not fed constantly to the cams 42*a*, which allows for prevention of excessive feeding of lubricant to the cams 42*a*.

The second oil passage 126 and the third oil passage 128 are provided so as to be symmetrical in the front-back direction in plan view and to have an identical cross-sectional shape. More specifically, the second oil passage 126 and the third oil passage 128 are configured to have the same length, cross-sectional shape, number of turns, and angle of turning. With this configuration, the lubricant fed from the first oil passage 124 has a substantially equal pressure loss in flowing the second oil passage 126 and the third oil passage 128; thus, the flow rate of lubricant is substantially the same in the second oil passage 126 and in the third oil passage 128. Hence, a substantially equal amount of lubricant is fed to the cams 42*a*.

As above, the lubricant feed mechanism for the engine 1 according to the present embodiment is configured to feed lubricant to a cam (a cam 40*a* and a cam 42*a*) of a valve gear 30 through a cylinder head 10, a camshaft (an intake-side camshaft 40 and an exhaust-side camshaft 42), and a cam cap 50. The mechanism includes an oil feed member 100 that is disposed in the cam cap 50 such that an upper end thereof is set at a lower level than an upper end of the cam cap 50 in the height-wise direction, and that has an oil passage (a first oil passage 124, a second oil passage 126, and a third oil passage 128) configured to guide lubricant to be fed through the cam cap 50 to the cam 40*a* and the cam 42*a*.

This configuration allows for feeding of lubricant to the cam 40*a* and the cam 42*a* without using the space above the cam cap 50. In this manner, interference among members is prevented, and design changes to avoid the interference are obviated.

The cam cap 50 has a recess (an intake-side recess 54 and an exhaust-side recess 62) provided around a bolt opening (an intake-side throughhole 56 and an exhaust-side throughhole 64) for fixedly attaching the cam cap 50 to the cylinder head 10, and the oil feed member 100 has a portion contained within the recess and is fixedly attached to the cylinder head 10 together with the cam cap 50 by a bolt 140.

With this configuration, the oil feed member 100 is secured by using an existing bolt 140, i.e., a bolt for fixedly attaching the cam cap 50 to the cylinder head 10, by which the use of an additional fastening member, such as a separately provided bolt, is dispensed with; thus, the number of components is reduced.

The oil feed member 100 includes a plurality of (two) panel members (a first panel member 110 and a second panel member 120) laid over each other, and a portion of the oil passage (a first oil passage 124, a second oil passage 126, and a third oil passage 128) in the oil feed member 100 is a groove carved on at least one surface (the upper surface of the second panel member 120) on which the two panel members of the oil feed member 100 abut each other.

This configuration facilitates formation of oil passages in the oil feed member 100.

The oil passage in the oil feed member 100 has two branches (the second oil passage 126 and the third oil passage 128) from a middle portion of the oil passage in such a manner as to guide lubricant to two cams 42*a*, and to feed an equal amount of lubricant to the two cams 42*a*.

This configuration allows for equal lubrication of the two cams 42*a*.

It is to be noted that, while the engine 1 according to the present embodiment is described as an inline 4-cylinder DOHC 16-valve gasoline engine, engines to which the present invention is applicable are not limited thereto.

Further, while in the present embodiment, oil passages in the oil feed member 100, i.e., the first oil passage 124, the second oil passage 126, and the third oil passage 128, are provided on the second panel member 120, the present invention is not limited thereto. More specifically, it is also conceivable that the passages are provided on the first panel member 110, or that the passages are provided on both the first panel member 110 and the second panel member 120, namely, the passages are provided at least one of the surfaces on which the panel members abut each other.

Further, the shape of the oil feed member 100 is not limited to the substantially L-shape in plan view as in the present embodiment, and the shape may be any shape insofar as lubricant is feedable to the cams, i.e., a cam 40*a* and a cam 42*a*.

Further, while in the present embodiment, the oil feed member 100 includes two panel members, i.e., the first panel member 110 and the second panel member 120, the present invention is not limited thereto. More specifically, for example, the oil feed member 100 may include a pipe insofar as the oil feed member 100 does not project upward from the cam cap 50.

Further, while in the present embodiment, the oil feed member 100 includes two panel members, i.e., the first panel member 110 and the second panel member 120, the present invention is not limited thereto. More specifically, the oil feed member 100 may include three or more panel members laid over one another. In this case, a groove is carved on any of the surfaces on which the plurality of (three or more) panel members abut each other so as to form an oil passage for guiding lubricant.

Further, while in the present embodiment, the oil feed member 100 includes a plurality of (two) panel members, i.e., the first panel member 110 and the second panel member 120, laid over each other, it is also conceivable that a seal member such as a gasket is interposed between the plurality of panel members.

Further, while in the present embodiment, the oil passage in the oil feed member 100 branches into two, i.e., the second oil passage 126 and the third oil passage 128, from a middle portion thereof, i.e., the first oil passage 124, the present invention is not limited thereto. More specifically, the oil passages in the oil feed member 100 may take a configuration of branching into two from an upstream end portion thereof, namely, the configuration in which two oil passages are provided from the beginning and not one oil passage branches from a middle portion.

Description is given below of other embodiments of the lubricant feed mechanism for an engine according to the present invention.

Figure 11A:
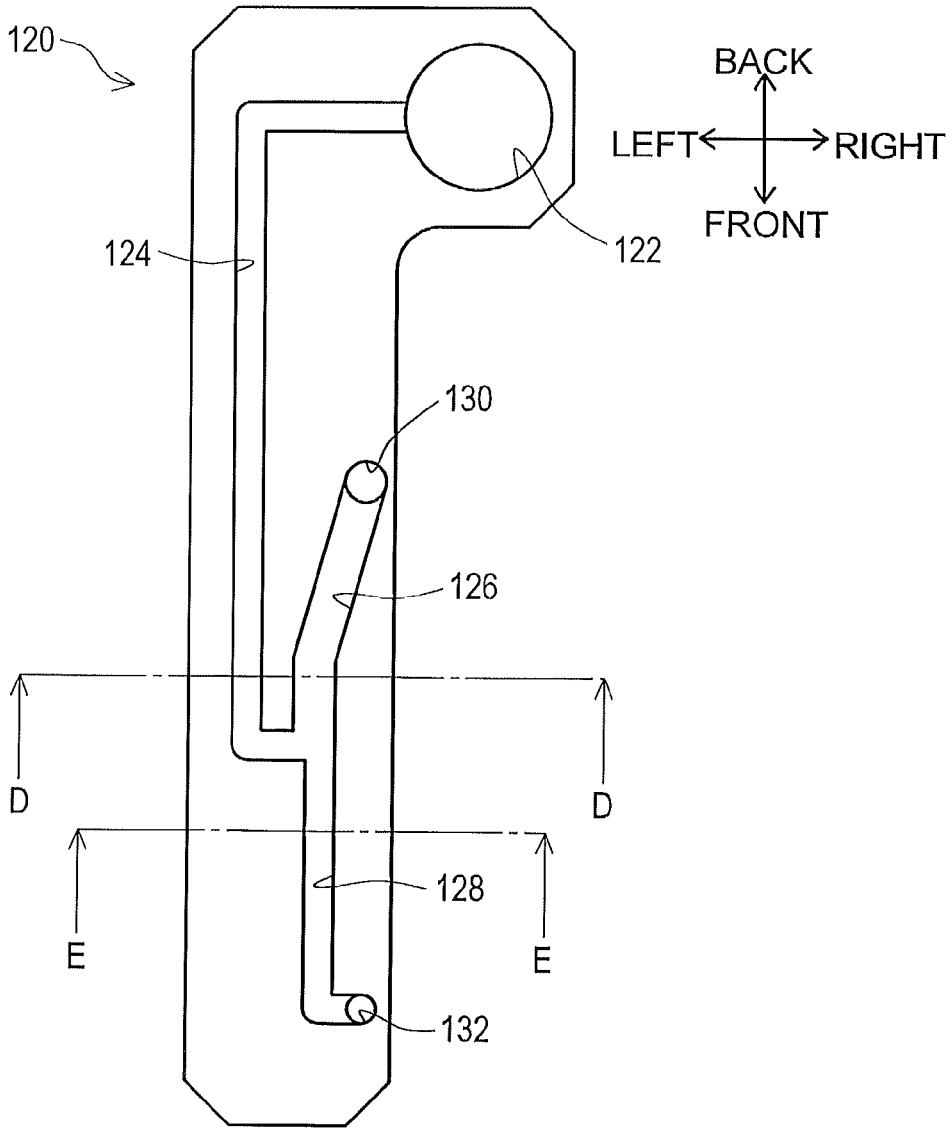
FIG. 11A is a plan view depicting a second panel member according to a second embodiment.
Figure 11B:
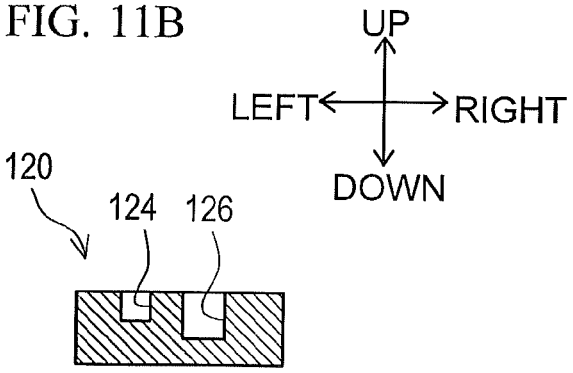
FIG. 11B is a front cross-sectional view depicting a cross section of the second panel member taken along line D-D.
Figure 11C:
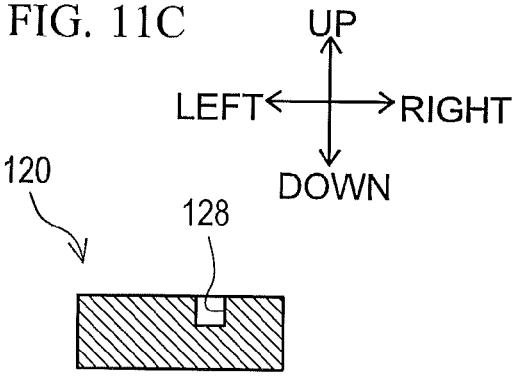
FIG. 11C is a front cross-sectional view depicting a cross section of the second panel member taken along line E-E.

As a second embodiment, the second oil passage 126 and the third oil passage 128 provided on the second panel member 120 may, as depicted in FIGS. 11A to 11C, have any lengths, cross-sectional shapes, numbers of turns, or angles of turning that are different from each other.

Specifically, in the second panel member 120 depicted in FIGS. 11A to 11C, the second oil passage 126 is larger in cross-sectional shape, namely, is wider and deeper, than the third oil passage 128. Further, the second oil passage 126 is configured to bend more moderately than the third oil passage 128, and thus the second oil passage 126 has a shorter length than the third oil passage 128.

In this manner, the second oil passage 126 and the third oil passage 128 are shaped to be asymmetrical with respect to each other, such that lubricant fed from the first oil passage 124 takes different pressure losses when flowing in the second oil passage 126 and in the third oil passage 128, and that the flow rates of the lubricant is made deliberately different between the second oil passage 126 and the third oil passage 128.

Figure 12:
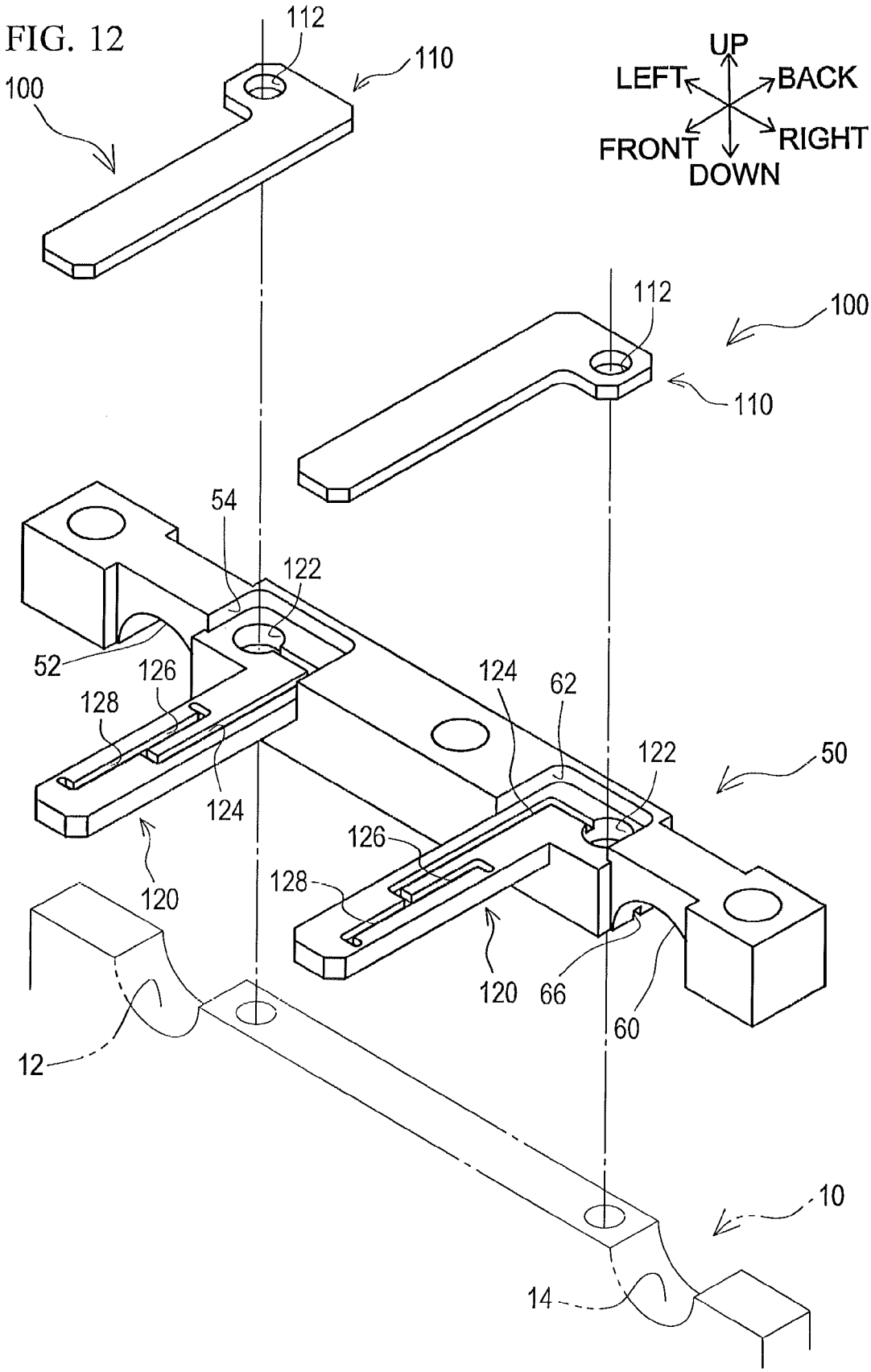
FIG. 12 is an exploded perspective view depicting a cam cap and oil feed members according to a third embodiment.

As depicted in FIG. 12, it is conceivable as a third embodiment that the second panel member 120 located at the lowermost layer of the plurality of (two) panel members, i.e. the first panel member 110 and the second panel member 120, configuring the oil feed member 100 (in the present embodiment, on the lower side of the two panel members, i.e., on the cam cap 50 side) is integrated with the cam cap 50. Specifically, second panel members 120 are integrated with the cam cap 50 so as to extend frontward from the intake-side recess 54 and the exhaust-side recess 62 of the cam cap 50, respectively; in this manner, the cam cap 50 and the second panel members 120 are handled as a single member. This configuration facilitates management of components of the cam cap 50 and the second panel members 120 and attachment to the cylinder head 10.

Figure 13:
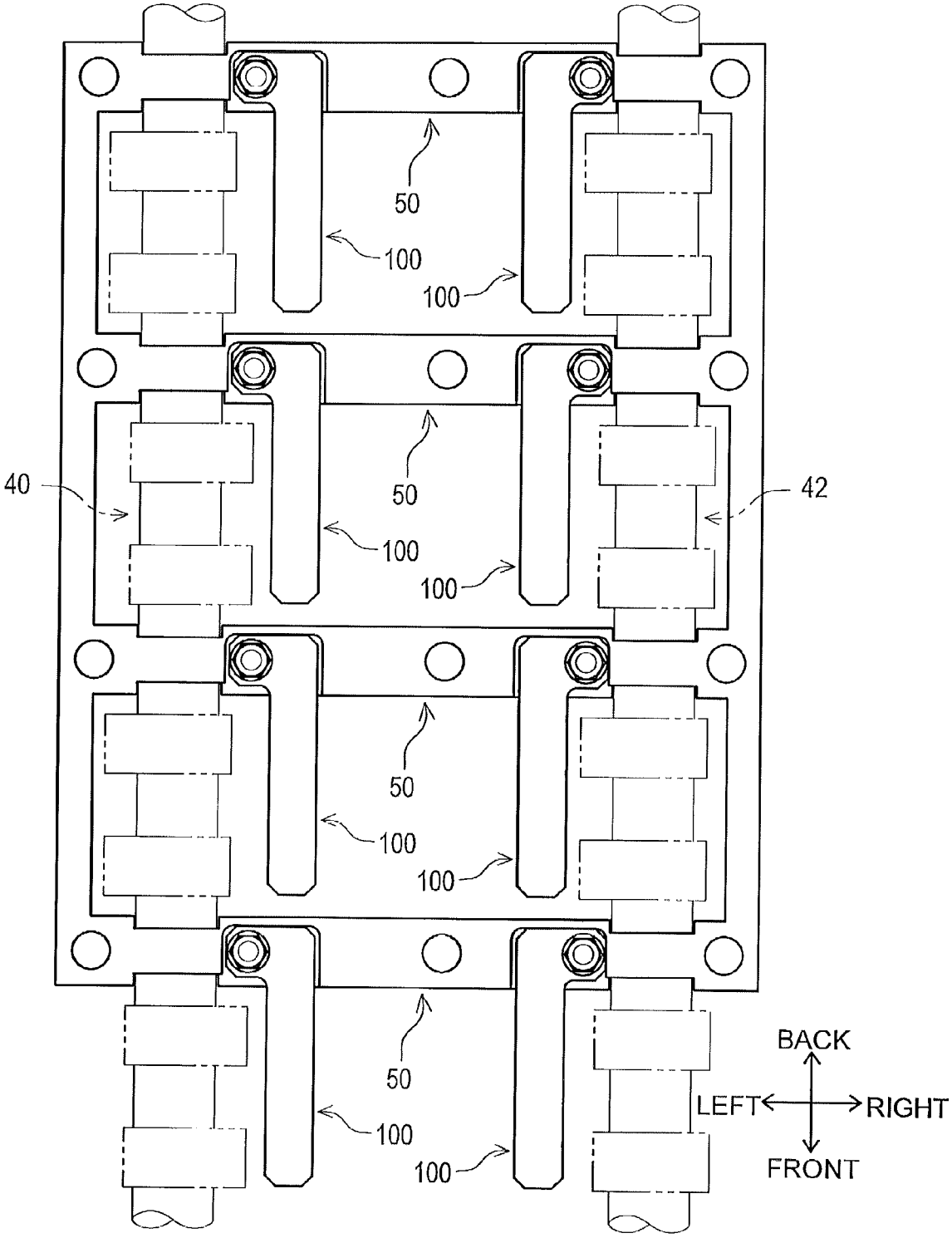
FIG. 13 is a plan view depicting a cam cap according to a fourth embodiment.

It is also conceivable as a fourth embodiment, as depicted in FIG. 13, that four cam caps 50 that are provided to correspond to the four cylinders, respectively, may be integrated with each other. Specifically, the right and left end portions of each cam cap 50 are coupled to each other, such that the four cam caps 50 are integrated with each other and are handled as a single member. This configuration facilitates management of components of the cam caps 50 and attachment to the cylinder head 10.

Figure 14:
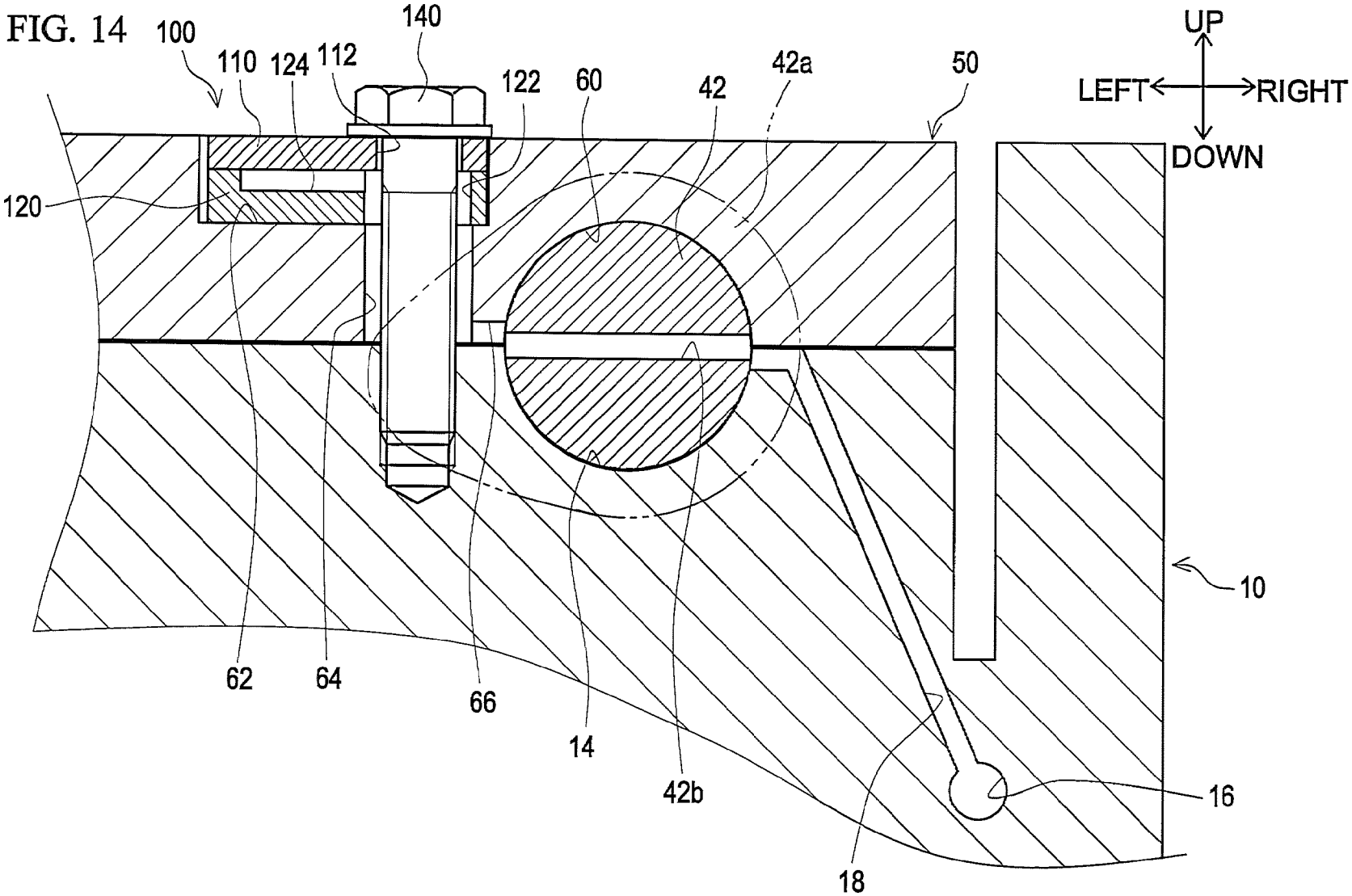
FIG. 14 is a front cross-sectional view depicting an exhaust-side camshaft according to a fifth embodiment.

It is also conceivable as a fifth embodiment, as depicted in FIG. 14, that the in-shaft oil passage 42*b* is formed linearly so as to pass the center of the rotation axis of the exhaust-side camshaft 42. In this case, the other end of the cam journal oil passage 18 communicates with a right end portion of the exhaust-side bearing 14. This configuration causes end portions of the in-shaft oil passage 42*b* to oppose the cam journal oil passage 18 per 180-degree rotation of the exhaust-side camshaft 42. This permits lubricant to be fed to the cams 42*a* per 180-degree rotation of the exhaust-side camshaft 42, i.e. twice during one rotation of the exhaust-side camshaft 42.

In the fifth embodiment (FIG. 14), the lubricant inside the in-shaft oil passage 42*b* changes the direction of flow reversely per 180-degree rotation of the exhaust-side camshaft 42. While the exhaust-side camshaft 42 is rotating at a lower speed, the lubricant inside the in-shaft oil passage 42*b* is fed, changing the direction of flow, into the exhaust-side communicating oil passage 66 per 180-degree rotation of the exhaust-side camshaft 42. Meanwhile, when the rotation of the exhaust-side camshaft 42 becomes faster, the lubricant inside the in-shaft oil passage 42*b* is unable to smoothly change the direction of flow and thus gets stagnant inside the in-shaft oil passage 42*b*. In other words, in case where the exhaust-side camshaft 42 rotates at a high speed, lubricant is stopped from being fed to the cams 42*a*.

In case, however, where the rotation of the exhaust-side camshaft 42 becomes faster, lubricant that is spattered by movement of other members adheres to the cams 42*a*; thus, lubrication to the cams 42*a* may be skipped. In other words, in case where, as in the fifth embodiment, the exhaust-side camshaft 42 rotates at a high speed, supply of lubricant to the cams 42*a* is stopped, such that excessive (wasteful) supply of lubricant is prevented.

INDUSTRIAL APPLICABILITY

The present invention is applicable to a lubricant feed mechanism for an engine for feeding lubricant to cams of a valve gear through a cylinder head, a camshaft, and cam caps.

DESCRIPTION OF REFERENCE SIGNS

1 Engine
10 Cylinder head
30 Valve gear
40 Intake-side camshaft
40*a* Cam
42 Exhaust-side camshaft
42*a* Cam
50 Cam cap
100 Oil feed member
110 First panel member
120 Second panel member
124 First oil passage
126 Second oil passage
128 Third oil passage
140 Bolt

The invention claimed is:

1. A lubricant feed mechanism for an engine, configured to feed lubricant to a cam of a valve gear through a cylinder head, a camshaft, and a cam cap, the mechanism comprising:

an oil feed member having an oil passage configured to guide lubricant to be fed through the cam cap to the cam, the oil feed member including a plurality of panel members laid over each other, the oil passage in the oil feed member being entirely or partly a groove formed on at least one surface of at least one of the panel members on which the panel members of the oil feed member abut each other.

2. The lubricant feed mechanism for an engine according to claim 1, wherein the oil feed member is disposed in the cam cap such that an upper end of the oil feed member is set at a lower level than an upper end of the cam cap in a height-wise direction.

3. The lubricant feed mechanism for an engine according to claim 2, wherein the cam cap has a recess provided around a bolt opening for fixedly attaching the cam cap to the cylinder head, and the oil feed member has a portion contained within the recess and the oil feed member is fixedly attached to the cylinder head together with the cam cap by a bolt.

4. The lubricant feed mechanism for an engine according to claim 2, wherein the oil passage in the oil feed member has two branches from an upstream end portion or a middle portion of the oil passage in such a manner as to guide lubricant to two cams, and to feed an equal amount of lubricant to the two cams.

5. The lubricant feed mechanism for an engine according to claim 2, wherein the oil passage in the oil feed member has two branches from an upstream end portion or a middle portion of the oil passage in such a manner as to guide lubricant to two cams, and to feed any different amounts of lubricant to the two cams.

6. The lubricant feed mechanism for an engine according to claim 2, wherein the panel member at the lowermost layer of the plurality of panel members configuring the oil feed member is integrally provided with the cam cap having the oil feed member disposed thereon.

7. The lubricant feed mechanism for an engine according to claim 2, wherein the engine includes a plurality of additional cam caps identical to the cam cap, all of the cam caps being integrally provided with each other.

8. The lubricant feed mechanism for an engine according to claim 1, wherein the cam cap has a recess provided around a bolt opening for fixedly attaching the cam cap to the cylinder head, and the oil feed member has a portion contained within the recess and the oil feed member is fixedly attached to the cylinder head together with the cam cap by a bolt.

9. The lubricant feed mechanism for an engine according to claim 8, wherein the oil passage in the oil feed member has two branches from an upstream end portion or a middle portion of the oil passage in such a manner as to guide lubricant to two cams, and to feed an equal amount of lubricant to the two cams.

10. The lubricant feed mechanism for an engine according to claim 8, wherein the oil passage in the oil feed member has two branches from an upstream end portion or a middle portion of the oil passage in such a manner as to guide lubricant to two cams, and to feed any different amounts of lubricant to the two cams.

11. The lubricant feed mechanism for an engine according to claim 8, wherein the panel member at the lowermost layer of the plurality of panel members configuring the oil feed member is integrally provided with the cam cap having the oil feed member disposed thereon.

12. The lubricant feed mechanism for an engine according to claim 8, wherein the engine includes a plurality of additional cam caps identical to the cam cap, all of the cam caps being integrally provided with each other.

13. The lubricant feed mechanism for an engine according to claim 1, wherein the oil passage in the oil feed member has two branches from an upstream end portion or a middle portion of the oil passage in such a manner as to guide lubricant to two cams, and to feed an equal amount of lubricant to the two cams.

14. The lubricant feed mechanism for an engine according to claim 13, wherein the panel member at the lowermost layer of the plurality of panel members configuring the oil feed member is integrally provided with the cam cap having the oil feed member disposed thereon.

15. The lubricant feed mechanism for an engine according to claim 13, wherein the engine includes a plurality of additional cam caps identical to the cam cap, all of the cam caps being integrally provided with each other.

16. The lubricant feed mechanism for an engine according to claim 1, wherein the oil passage in the oil feed member has two branches from an upstream end portion or a middle portion of the oil passage in such a manner as to guide lubricant to two cams, and to feed any different amounts of lubricant to the two cams.

17. The lubricant feed mechanism for an engine according to claim 16, wherein the panel member at the lowermost layer of the plurality of panel members configuring the oil feed member is integrally provided with the cam cap having the oil feed member disposed thereon.

18. The lubricant feed mechanism for an engine according to claim 16, wherein the engine includes a plurality of additional cam caps identical to the cam cap, all of the cam caps being integrally provided with each other.

19. The lubricant feed mechanism for an engine according to claim 1, wherein the panel member at the lowermost layer of the plurality of panel members configuring the oil feed member is integrally provided with the cam cap having the oil feed member disposed thereon.

20. The lubricant feed mechanism for an engine according to claim 1, wherein the engine includes a plurality of additional cam caps identical to the cam cap, all of the cam caps being integrally provided with each other.

* * * * *